US005197793A

United States Patent [19]

Stone

[11] Patent Number: 5,197,793

[45] Date of Patent: Mar. 30, 1993

[54] VENDING MACHINE WITH SAFETY ELECTRICAL BACK LIGHT SIGN ASSEMBLY AND METHOD

[75] Inventor: David H. Stone, Delavan, Wis.

[73] Assignee: Glo-Max Fiber Optic Systems, Inc., Walworth, Wis.

[21] Appl. No.: 800,145

[22] Filed: Nov. 27, 1991

Related U.S. Application Data

[63] Continuation-in-part of Ser. No. 771,258, Oct. 4, 1991.

[51] Int. Cl.[5] ..... G09F 13/04

[52] U.S. Cl. ..... 362/32; 362/30; 362/260; 362/812; 221/155; 40/547

[58] Field of Search ..... 362/27, 29, 30, 32, 362/125, 260, 806, 812; 312/223; 40/547, 545, 581, 444; 221/155

[56] References Cited

U.S. PATENT DOCUMENTS

| | | | |
|---|---|---|---|
| 1,982,236 | 11/1934 | Simpkins | 221/155 |
| 3,184,872 | 5/1965 | Way | 40/547 |
| 3,381,121 | 4/1968 | McDonald | 362/812 |

FOREIGN PATENT DOCUMENTS

| | | | |
|---|---|---|---|
| 3404330 | 8/1985 | Fed. Rep. of Germany | 40/442 |
| 253084 | 10/1989 | Japan | 221/155 |
| 37490 | 2/1990 | Japan | 40/545 |
| 40788 | 2/1990 | Japan | 221/155 |
| 8500959 | 11/1986 | Netherlands | 40/545 |

*Primary Examiner*—Ira S. Lazarus
*Assistant Examiner*—Y. Quach
*Attorney, Agent, or Firm*—Potthast & Ring

[57] ABSTRACT

A vending machine (10) with a safety electrical back light sign assembly (32) having a sign panel assembly with a translucent sign panel (18A) and a fiber optic sign panel (18B) secured together to form an enclosure of a main housing (16) within which is contained a back light source (32A, 34B) having its own source of power (33, 35) shared with the other vending machine components (12, 14) and a fiber optic light assembly (36) with a fiber optic light source (38) protectively contained within a fire resistant housing (51) mounted within the housing (16) and having its own connection to AC power (47, 49) separate from the connection for the remainder of the vending machine (10) and a fan (63) to exhaust the interior of the fire resistant housing (51) of hot air, and a method of safe lighting of a sign panel assembly (18) of a vending machine (10).

17 Claims, 2 Drawing Sheets

VENDING MACHINE WITH SAFETY ELECTRICAL BACK LIGHT SIGN ASSEMBLY AND METHOD

CROSS REFERENCE TO RELATED APPLICATION

This application is a continuation-in-part of my copending U.S. application Ser. No. 07/771,258, filed Oct. 4, 1991, entitled "Vending Machine Back Light Assembly and Method" and application Ser. No. 07/796,326, filed Nov. 22, 1991, entitled "Fiber Optic Safety Sign and Method".

BACKGROUND OF THE INVENTION

1. Field of the Invention

This invention generally relates to electrical back lit signage and, particularly, to a fire resistant fiber optic back light assembly.

2. Description of the related art including information disclosed under 37 CFR 1.97-1.99

In my copending application, U.S. application Ser. No. 07/771,258 filed Oct. 4, 1991, and entitled "Vending Machine Back Light Assembly and Method", I disclose a vending machine with a unique back light assembly which is comprised of a translucent sign panel and a fiber optic sign panel with associated light sources which cooperate to provide back light for both panels. While this vending machine works well, it has been determined that in some applications, it is desirable to protect such vending machines against the additional risk of fire caused by provision of a relatively high intensity fiber optic light source in the vending machine.

In my copending application, U.S. application Ser. No. 07/796,326, filed Nov. 22, 1991, and entitled "Fiber Optic Safety Sign and Method", a fiber optic safety sign is disclosed in which all of the components of the fiber optic high intensity light source are contained within a fire resistant housing to enable it to withstand harsh ambient environments in chemical plants, oil rigs, coal mines and the like.

SUMMARY OF THE INVENTION

It is therefore the principal object of the present invention to provide a vending machine like that of my aforementioned patent application Ser. No. 07/771,258 but which incorporates some of the features of the fiber optic safety sign of my other aforementioned invention disclosed in U.S. application Ser. No. 07/796,326 and entitled "Fiber Optic Safety Sign and Method" to decrease the fire risk of provision of a relatively high intensity light source in a vending machine in the same housing with a translucent sign panel light source and a method of safely providing a fiber optic signage in a vending machine.

The object of the present invention is achieved in part by provision of a vending machine which has a dispenser mechanism for dispensing a food item and a controller responsive to receipt payment for actuating the dispenser contained within a main housing, with a safety electrical back light sign assembly comprising a sign panel assembly with a translucent sign panel, a fiber optic sign panel and means for securing together the translucent sign panel and the fiber optic sign panel to define a substantially coplanar closure for the main housing, a translucent back light assembly and a fiber optic light assembly. The translucent back light assembly includes a translucent back light source for providing back light to the translucent sign panel, means for mounting the translucent light source within the main housing and means for providing power from without the main housing to the fluorescent light source within the main housing. The fiber optic light assembly includes a fire resistant, fiber optic, back light source housing, a fiber optic light source assembly with a fiber optic light source protectively contained within the fire resistant, fiber optic, light source housing, a fiber optic cable assembly with a fiber optic cable for receiving light from the fiber optic light source within the fiber optic light source housing and conveying it to the fiber optic sign panel outside of the fire resistant, fiber optic, light source housing and means for mounting the fire resistant, fiber optic light source housing within the main housing, and another means for providing power from outside of both the fire resistant, fiber optic, light source housing and the main housing to the fiber optic light source within the fire resistant, fiber optic, light source housing.

The object of the present invention is also achieved in part by providing a method of safety lighting a sign panel assembly defining one side of a main housing of a vending machine, comprising the steps of protectively enclosing a fiber optic light source in a fire resistant housing contained within the main housing, conveying a relatively high intensity light from the fiber optic light source within the fire resistant housing and the main housing to the fiber optic sign panel via a fiber optic cable passing through a sealed opening in the fire resistant housing and conveying a relatively low intensity light from another light source within the main housing and outside of the fire resistant housing to a translucent sign panel of the sign panel assembly.

BRIEF DESCRIPTION OF THE DRAWING

The foregoing objects and advantageous features of the invention will be explained in greater detail and others will be made apparent from the detailed description of the preferred embodiment of the present invention which is given with reference to the several figures of the drawing, in which.

DESCRIPTION OF THE PREFERRED EMBODIMENT

Figure 1:
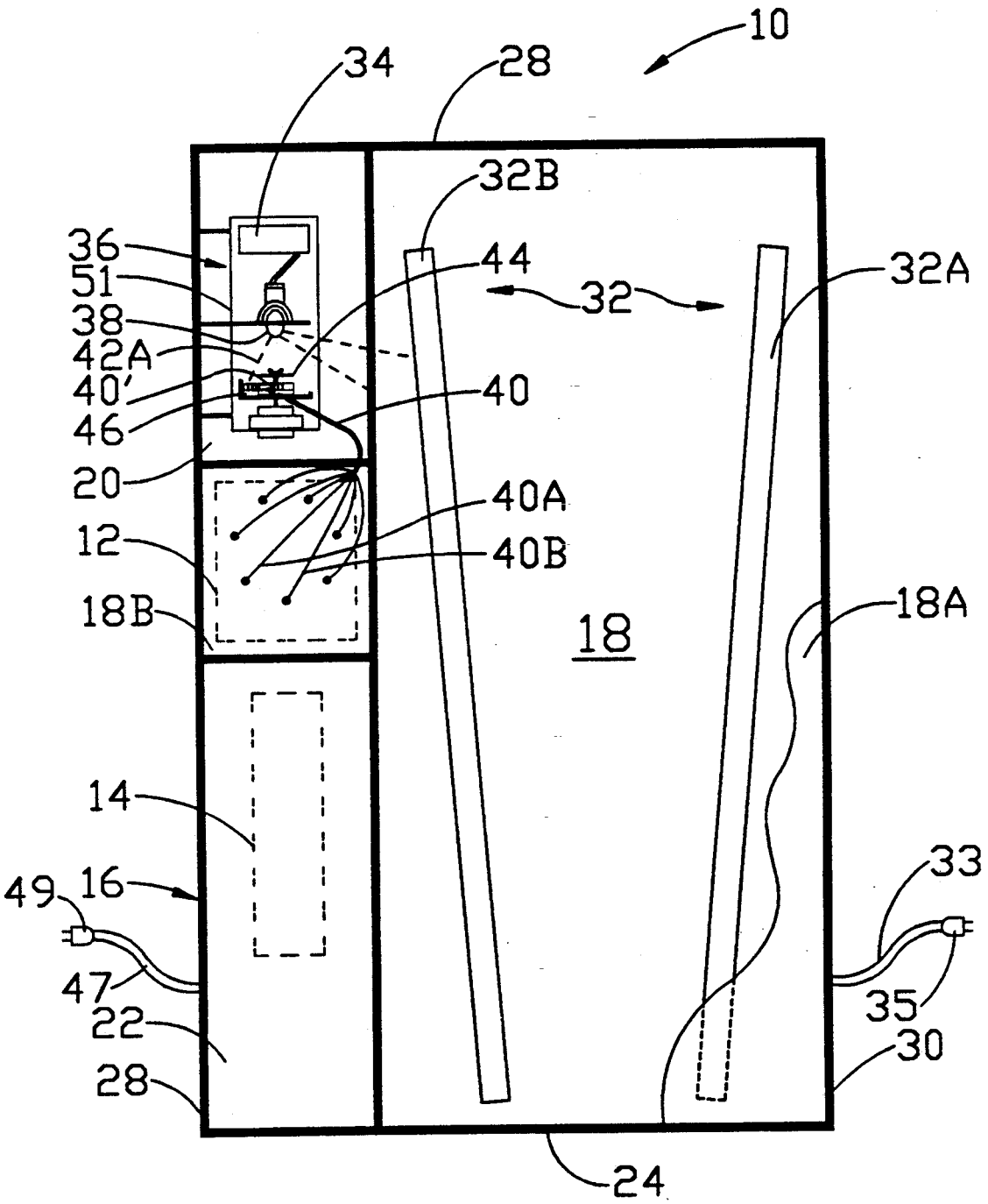
FIG. 1 is a front view of the preferred embodiment of the vending machine of the present invention which includes an electrical back light assembly of which the fiber optic light source assembly and fiber optic sign panel of the present invention are a part.

Referring now to FIG. 1, the preferred embodiment of the vending machine 10 of the present invention is seen to include a mechanism for dispensing a food item, or dispenser, 12 and a controller 14 responsive to receipt of payment for actuating the dispenser 12. Both the dispenser 12 and the controller 14 are mounted within a rectangular main housing 16 which is defined in part by a translucent sign panel assembly 18 that bears a sign and logo (not shown). The sign panel assembly 18 includes a relatively large first rectangular translucent panel 18A and a relatively small, second translucent fiber optic sign panel 18B. The first and second sign panels 18A and 18B are secured together with each other and with two other panels 20 and 22 in flush relationship to form a rectangular front of the rectangular main housing 16. The rectangular main housing 16 also has a bottom 24, top 26 and opposite side walls 28 and 30.

The housing 16 also protectively contains a translucent back light assembly 32 which includes fluorescent lights 32A and 32B. The fluorescent lights 32A and 32B are mounted to the rectangular main housing 16 and extend substantially the entire height of the main housing 16 between bottom 24 and top 26 and function as the only light source for back lighting of the first translucent panel 18A. Both fluorescent lamps 32A and 32B receive electrical power from a suitable electrical AC power source 50, FIG. 2, through means of a suitable electrical cord 33 and AC plug 35.

The second translucent sign panel 18B is located relative to the fluorescent lamps 32A and 32B of the first back light assembly to allow light to traveling therefrom to impinge upon and thus back light the second translucent sign panel 18B. However, as will be explained, while it is desirable to have some of the light from lamp 32A and lamp 32B to strike the second translucent panel 18B, an obstruction in the preferred form of the dispenser 12 is located intermediate the second translucent sign panel 18B and the lamps 32A and 32B and approximately one fourth inch away from the back of the second panel 18B to partially occlude the light. In this way, the light is partly occluded to ensure that the primary back light for the second translucent sign panel 18B comes from a second back light assembly 36, described in detail below. However, should the second back light assembly 36 fail to operate, some back light will still be available to at least partially back light the second sign panel 18B. The second, or fiber optic back light assembly 36 is located above the dispenser and aligned with, rather than opposite of, the back of panel 18B.

Instead of relying upon the transmission of light through space in which a plastic-like sign panel is directly exposed to a light source, as with the translucent back light assembly 32, in keeping with the present invention, the light from a relative intense, fiber optic, light source, preferably a halogen lamp, 38 is conveyed via a fiber optic cable 40 made of a plurality of fiber optic filaments, such as filaments 40A, 40B, etc. Advantageously, light from halogen lamp 38 is conveyed through air via path 42A to a receiving end 40' of the fiber optic cable 40 but only within a protective, fire resistant housing 51. As will be explained in greater detail with reference to FIG. 2, the second back light assembly 36 also includes a rotatably mounted color wheel 44 comprised of a plurality of different color filters on a disc through which light from halogen lamp 38 passes before striking the receiving end 40' of the fiber optic cable 40. An electric motor 46 functions to drive the color wheel 44 to rotate and thereby partially change the spectrum of the light conveyed to the second translucent sign panel 18B. These are also protectively contained within the fire resistant housing 51.

Thus, partial achievement of the objective of the invention is obtained by provision of a fire resistant housing 51 preferably made of sheet metal which entirely encloses the second, or relatively high intensity fiber optic light source assembly 38 against the entry of air. The fire resistant housing 51 is releasably mounted within the main housing 16 by means of suitable fasteners, such as posts or screws mounted to housing wall 28 and associated mounting holes 64 which enable easy removal for replacement or repair. A fan 63, FIG. 2, vents hot air from the halogen lamp 38 out of the fire resistant housing 51 through an exhaust opening 53.

In keeping with one aspect of the invention, power for the halogen lamp 38 and the electrical motor 46 are obtained from a standard AC power supply via an AC power cord 47 and plug 49 separate and apart from the AC power cord 33 for providing the remainder of the vending machine components with power. In this way, any overload or electrical short in the circuits for providing power to the halogen lamp 38 or the electrical motor 46 will not adversely affect the fluorescent lamp or other electrical circuitry or power through power cord 33 and plug 35 through which they receive power.

Figure 3:
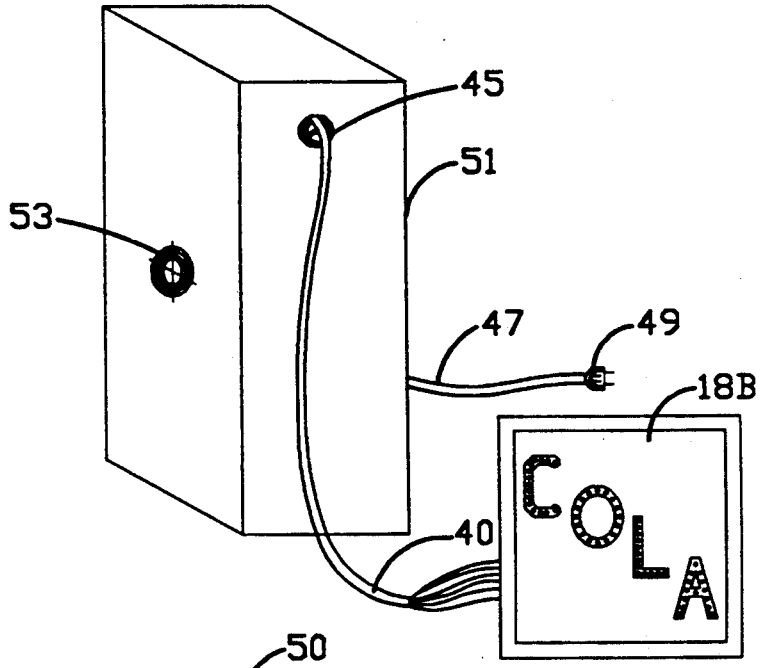
FIG. 3 is a perspective view of a preferred embodiment of a fiber optic light source assembly housing and fiber optic sign panel of the safety electrical back light assembly shown in FIG. 1.
Figure 2:
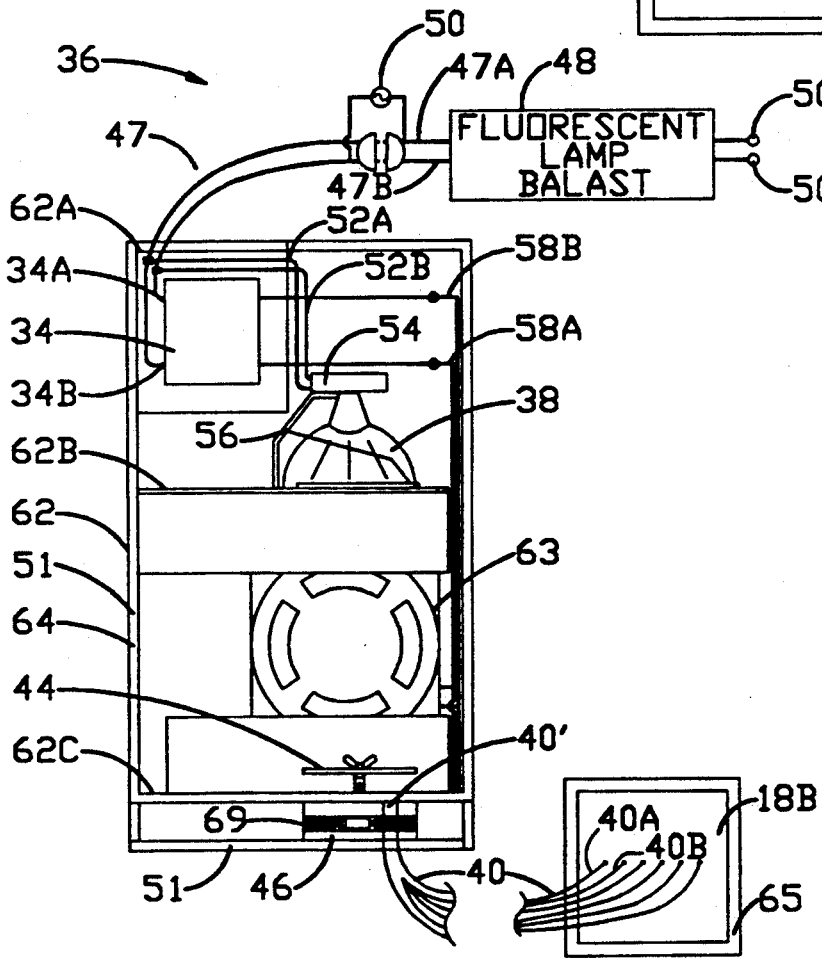
FIG. 2 is a schematic illustration of the components of the fiber optic light source assembly of FIG. 1 within their fire resistant housing.

Turning now to FIGS. 2 and 3, the power cord 47 of the second back light assembly 36 makes electrical connection with a pair of inputs 34A and 34B of transformer 34, while the inputs 47A and 47B of a fluorescent lamp ballast 48 derives power from a conventional source of AC power 50 via AC power cord 47. The fluorescent lamp ballast has outputs 50A and 50B which are connected to power fluorescent lamps 32A and 32B, FIG. 1. The inputs of transformer 34A and 34B are connected via suitable connectors 52A and 52B to a lamp socket 54 releasably connected to apply power to halogen lamp 38. The halogen lamp 38, preferably not larger than seventy-five watts, is supported in engagement with the lamp socket 54 via a lamp support clip 56. The transformer 34 also has a pair of outputs 58A and 58B connected to power both the electrical motor 46 and also an electrical fan 63. The fan 63 is interposed between the lamp 38 and the color wheel 44 to control the housing temperature and prevent excess heat accumulation adjacent the halogen lamp 38 for enhanced useful life and improved safety.

The receiving end 40' of the fiber optic cable 40 extends through a sealed opening in the fire resistant housing and is held in place beneath one side of the color wheel 44 by means of a releasable strap 69. The fiber optic cable 40 is then flexibly routed downwardly from the receiving end 40' to the second translucent sign panel 18B. The ends of the filaments 40A, 40B, etc. are inserted into mating holes in the back side of the translucent sign panel 18B and held there by a suitable adhesive.

The objective of the invention is achieved in part by mounting all of the components of the second back light subassembly within the fire resistant housing 51. All of the lamp socket 54, color wheel 44 and the end of the fiber optic cable 40' and the electrical motor 46 including its stuber body and fan are mounted within the same fire resistant housing 51 by means of one or more transverse arms 62A, 62B and 62C in a preselected spatial relationship, as shown. In addition, since the elements of the back light assembly 36 are secured together by means of fire resistant housing 51, all internal wiring between the transformer 34 and the frame 62 and motor 46 are advantageously preconnected. The fiber optic sign panel 18B is connected at the end of the filaments 40A, 40B, etc. to form an advertising message, as shown in FIG. 3. The fiber optic sign panel 18B also has means carried by a frame 65 to releasably mount it in generally flush engagement with the sign translucent panel 18A.

Thus, it is seen that the invention provides a method of safe lighting a sign panel assembly 18 defining one side of a main housing of a vending machine 10, comprising the steps of protectively enclosing a fiber optic light source 38 in a fire resistant housing 51 contained within the main housing 16, conveying a relatively high intensity light from the fiber optic light source 38 within the fire resistant housing 51 and the main housing 16 to the fiber optic sign panel 18B via a fiber optic cable 40 passing through a sealed opening 45 in the fire resistant housing 51 and conveying a relatively low intensity light from another light source 32A and 32B within the main housing 16 and outside of the fire resistant housing 51 to a translucent sign panel 18A of the sign panel assembly 18. Preferably, the method includes the steps of conveying electrical power from without the main housing 16 to the relatively high intensity light source 38 and the relatively low intensity light source 32A and 32B by two separate electrical cords 33 and 47, exhausting hot air from within the fire resistant housing with a fan 63 with the housing 51 and changing the color of the relatively high intensity light conveyed through the fiber optic cable by means substantially contained entirely within the fire resistant housing 51.

The safe back light method of this invention also preferably includes the steps of releasably mounting the fire resistant housing 51 within the main housing 16 to facilitate removal for replacement and repair, dismounting the fire resistant housing 51 and the fiber optic light source 38 contained therewithin from within the main housing 16 for repairs and releasably mounting another fire resistant housing 51 and another fiber optic light source 38 contained therein to the main housing 16 in lieu of the ones dismounted from the main housing 16 for repair.

While a detailed description of the preferred embodiment of the invention has been given, it should be appreciated that many variations can be made thereto without departing from the scope of the invention as set forth in the appended claims.

I claim:

1. In a vending machine having a dispenser mechanism for dispensing a food item and a controller responsive to receipt of payment for actuating the dispenser mechanism, all contained within a main housing, the improvement being a safety electrical back light sign assembly, comprising:

a sign panel assembly including
- a translucent sign panel,
- a fiber optic sign panel, and
- means for securing together the translucent sign panel and the fiber optic sign panel to define a substantially coplanar closure for the main housing;

a translucent back light assembly including
- a translucent back light source for providing back light to the translucent sign panel,
- means for mounting the translucent back light source within the main housing, and
- means for providing power from without the main housing to a fluorescent light source within the main housing; and a fiber optic back light assembly including
- a fire resistant, fiber optic, back light source housing,
- a fiber optic light source assembly including a fiber optic light source protectively contained within the fire resistant, fiber optic, back light source housing,
- a fiber optic cable assembly including a fiber optic cable for receiving light from the fiber optic light source within the fire resistant, fiber optic, back light source housing and conveying light to the fiber optic sign panel without the fire resistant, fiber optic, back light source housing, and
- means for mounting the fire resistant, fiber optic back light source housing within the main housing, and
- another means for providing power from outside of both the fire resistant, fiber optic, back light source housing and the main housing to the fiber optic light source within the fire resistant, fiber optic, back light source housing.

2. The vending machine of claim 1 in which the fire resistant, fiber optic, back light source housing substantially encloses the entire fiber optic light source against the entry of air.

3. The vending machine of claim 1 in which the fiber optic light source assembly includes a fan for exhausting hot air out of the fire resistant, fiber optic, back light source housing.

4. The vending machine of claim 3 in which said fan exhausts hot air from within the fire resistant, fiber optic, back light source housing into the main housing.

5. The vending machine of claim 1 in which
- said fiber optic light source includes a halogen-like lamp, and
- said fiber optic light source assembly includes a fan for exhausting heat of the halogen-like lamp from the fire resistant fiber optic, back light source housing.

6. The vending machine of claim 1 in which said fire resistant, fiber optic, back light source housing is made substantially of sheet metal.

7. The vending machine of claim 1 in which
- said sign panel assembly includes means for mounting the fiber optic sign panel directly opposite the dispenser mechanism, and
- said fire resistant, fiber optic, back light source housing mounting means includes means for mounting the fire resistant, fiber optic, back light source housing to the main housing at a location spaced from the dispenser mechanism, and
- said fiber optic cable assembly includes means for routing the fiber optic cable from the fiber optic light source past the dispenser mechanism to the fiber optic sign panel.

8. The vending machine of claim 1 in which
- said translucent back light source includes a fluorescent lamp, and
- said fiber optic light source assembly includes a halogen lamp.

9. The vending machine of claim 1 in which said fiber optic light source assembly includes
- a color wheel interposed between the fiber optic light source and the fiber optic cable, and
- means mounted to the fiber optic light source assembly for rotating the color wheel to vary the color of the light conveyed by the fiber optic cable.

10. The vending machine of claim 9 in which said color wheel rotating means includes
- an electric motor connected to said other power providing means and having a stator body, and
- means for mounting the electric motor to a metal wall of said fire resistant, fiber optic, back light source housing with said stator body substantially contained within the fire resistant, the fiber optic, back light source housing.

11. A method of safely lighting a sign panel assembly defining one side of a main housing of a vending machine, comprising the steps of:

protectively enclosing a relative high intensity fiber optic light source in a fire resistant housing contained within the main housing;

conveying a relatively high intensity light from the relatively high intensity fiber optic light source within the fire resistant housing and the main housing to a fiber optic sign panel via a fiber optic cable passing through a sealed opening in the fire resistant housing; and conveying a relatively low intensity light from a relatively low intensity light source within the main housing and outside of the fire resistant housing to a translucent sign panel of the sign panel assembly.

12. The method of claim 11 including a step of conveying electrical power from without the main housing to the relatively high intensity fiber optic light source and the relatively low intensity light source by two separate electrical cords.

13. The method of claim 11 including a step of exhausting hot air from within the fire resistant housing.

14. The method of claim 11 including a step of changing the color of the relatively high intensity light conveyed through the fiber optic cable by means substantially contained entirely within the fire resistant housing.

15. The method of claim 11 including a step of releasably mounting the fire resistant housing within the main housing to facilitate removal for replacement and repair.

16. The method of claim 15 including the steps of dismounting the fire resistant housing and the fiber optic light source contained therewithin from within the main housing for repairs, and releasably mounting another fire resistant housing and another fiber optic light source contained therein to the main housing in lieu of the fire resistant housing and fiber optic light source dismounted from the main housing for repair.

17. The method of claim 11 including a step of exhausting air out of the fire resistant housing by means contained within the main housing.

* * * * *

UNITED STATES PATENT AND TRADEMARK OFFICE

CERTIFICATE OF CORRECTION

PATENT NO. : 5,197,793

DATED : 3/30/93

INVENTOR(S) : David H. Stone

It is certified that error appears in the above-identified patent and that said Letters Patent is hereby corrected as shown below:

Column 3, line 23, before "traveling" delete "to";

Column 4, line 1, after "source" delete "assembly";

Column 4, line 56, after "fan" add - 63 -; and

Column 6, line 34, after "resistant" add - , -.

Signed and Sealed this

Twentieth Day of September, 1994

*Attest:*

Bruce Lehman

BRUCE LEHMAN

*Attesting Officer*

*Commissioner of Patents and Trademarks*